US007218748B1

(12) United States Patent
Stompler

(10) Patent No.: US 7,218,748 B1
(45) Date of Patent: May 15, 2007

(54) TAPERED THICKNESS SURROUND FOR HIGH EXCURSION SPEAKER DRIVER

(75) Inventor: Thilo Stompler, San Diego, CA (US)

(73) Assignee: TC Sounds Inc., San Diego, CA (US)

( * ) Notice: Subject to any disclaimer, the term of this patent is extended or adjusted under 35 U.S.C. 154(b) by 610 days.

(21) Appl. No.: 10/752,113

(22) Filed: Jan. 6, 2004

Related U.S. Application Data

(60) Provisional application No. 60/438,488, filed on Jan. 7, 2003.

(51) Int. Cl.
*H04R 1/00* (2006.01)
*H04R 7/00* (2006.01)

(52) U.S. Cl. ..... 381/392; 181/172

(58) Field of Classification Search ..... 381/150, 381/386, 391, 392, 395, 396; 181/166, 171, 181/172, 173, 174
See application file for complete search history.

(56) References Cited

U.S. PATENT DOCUMENTS 6,305,491 B2 * 10/2001 Iwasa et al. ..... 181/172

* cited by examiner

*Primary Examiner*—Sinh Tran
*Assistant Examiner*—Brian Ensey
(74) *Attorney, Agent, or Firm*—Michael W. Landry

(57) ABSTRACT

A speaker driver surround has tapered thickness to provide improved linearity of the force versus displacement response. The tapered thickness surround provides for a larger emissive piston area, thus increasing the acoustic efficiency of the transducer. The surround has an integral gasket with a groove to accept grill to cover the speaker cone.

8 Claims, 7 Drawing Sheets

ø14.75 [374.65]
1.75 [44.45]
210
220
100

HONEYCOMB

TAPERED THICKNESS SURROUND FOR HIGH EXCURSION SPEAKER DRIVER

RELATED APPLICATIONS

This application claims priority to U.S. provisional patent application Ser. No. 60/438,488 filed Jan. 7, 2003 entitled "Tapered Thickness Surround For High Excursion Speaker Driver".

BACKGROUND

A surround is a flexible annular ring connecting between the basket and the cone and provides a movable support for the speaker driver cone. Surrounds are commonly made from compressed foam or molded elastomer. As the driver cone is displaced by the force of the voice coil along the axis of travel, the surround is stretched from its resting position. The force required to move the cone and surround changes as a function of displacement distance in a non-linear fashion. This causes audio distortion. This non-linear effect is particularly evident in high excursion drivers because the non-linearity of the force/displacement relationship increases at high displacements.

The surround and gasket are normally two separate parts.

SUMMARY OF THE INVENTION

A surround has varied thickness to create a more linear force to displacement relationship. The thickness of the surround is varied from the base of the surround to the apex. The surround has a different thickness on the inside diameter base and the outside diameter base to result in a more linear and symmetric force versus displacement curve in both up and down directions.

The surround and gasket are one integral part. The combined component eliminates tolerance and alignment problems between conventional surrounds and gaskets. Integrating the surround and the gasket allows the surround to be offset with respect to the attaching surface on the basket upwards to provide increased clearance. The surround has a groove to accommodate the grill with an interference fit.

The surround is narrow yet capable of high excursion. The narrow width of the surround also allows an increase in the cone surface, which is the primary emissive surface, thus making the driver more efficient.

DETAILED DESCRIPTION OF THE INVENTION

Figure 1:
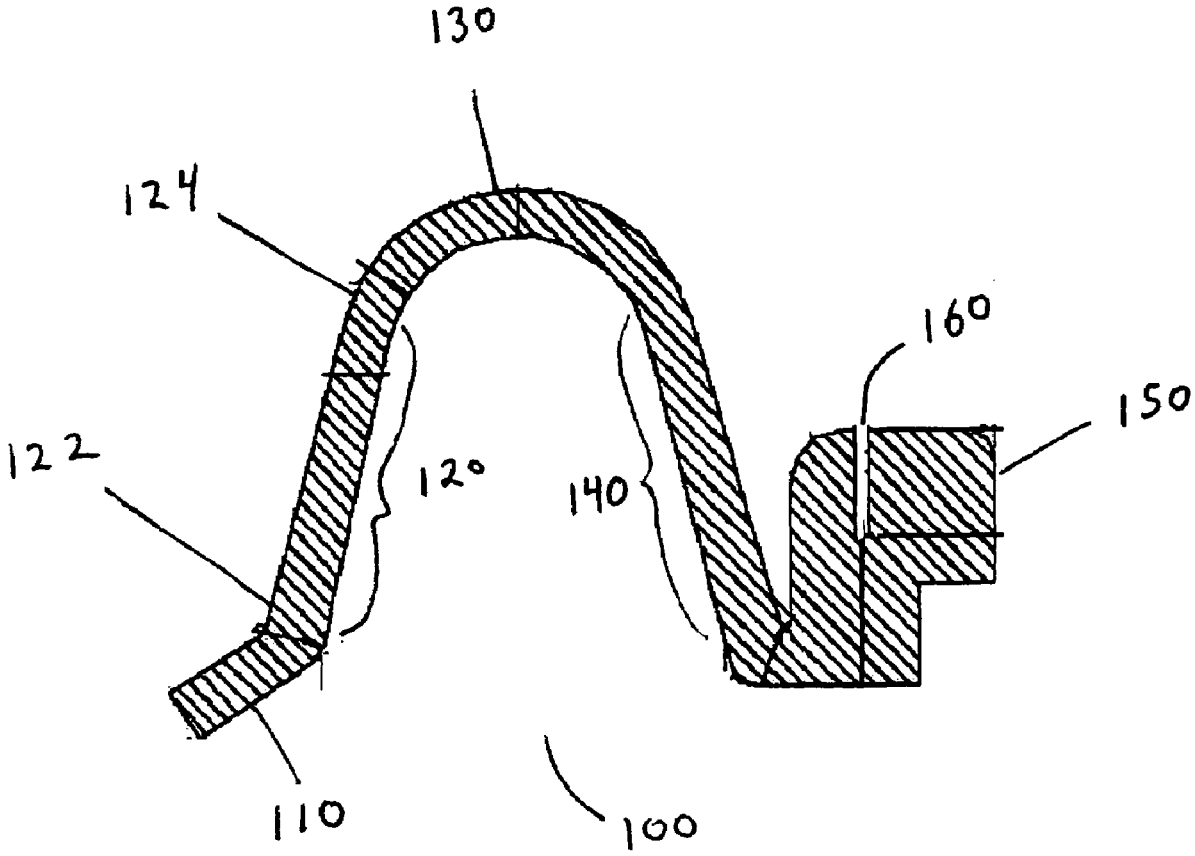
FIG. 1 shows a cross section view of a surround according to the present invention.

Referring to FIG. 1, a cross section view of a surround 100 according to the present invention, a cone mounting region 110 allows the surround to be attached at the inside edge to a cone, which moves in response to force applied by a voice coil. The cone mounting region 110 is adjacent to an inner rising region 120. An arch region 130 is a curved segment that connects the inner rising region 130 to an outer rising region 140. The outer rising region 140 is adjacent to a gasket 150 that mounts the surround 100 to the driver basket, not shown. The inner and outer rising regions 120 and 140 along with the arch region 130 allow the surround to extend above and below the resting position as the cone is displaced by the voice coil. These three regions will experience a change in shape as the surround moves. Base 122 is thicker than apex 124. Both the inner and outer rising regions 120 and 140 have a thicker base and thinner apex with an approximately linear taper thickness in between.

A groove 160 with a rectangular shape is used to attach a grill to the front of the driver. Friction or glue holds the grill in the groove.

Figure 5:
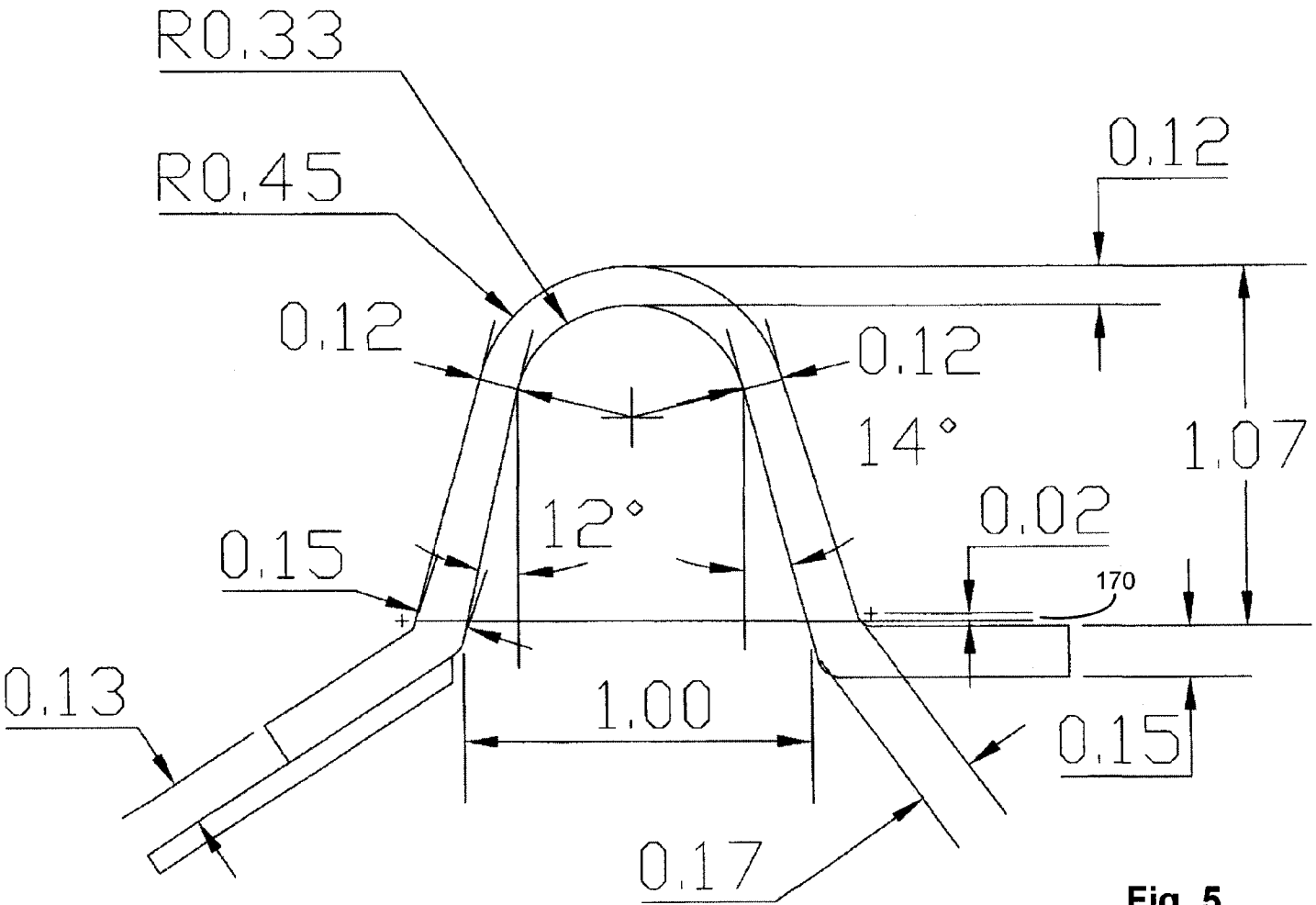
FIG. 5 shows a cross section view with dimensions of the thickness profile of an embodiment of the surround.
Figure 6:
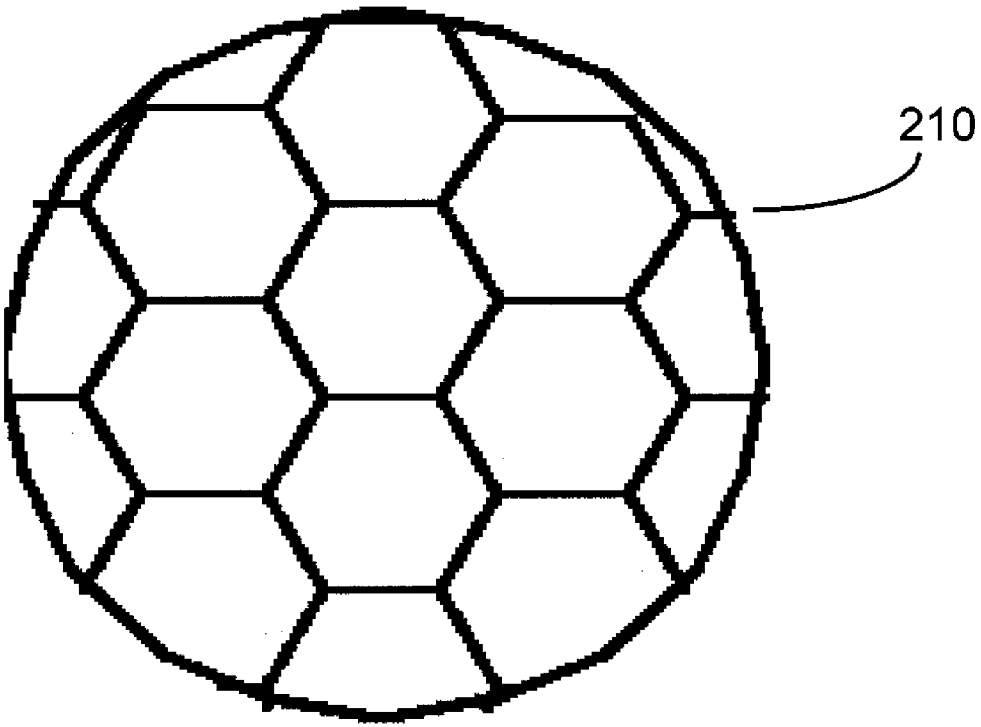
FIG. 6 shows a honeycomb pattern of a grill for use with the present invention.
Figure 7:
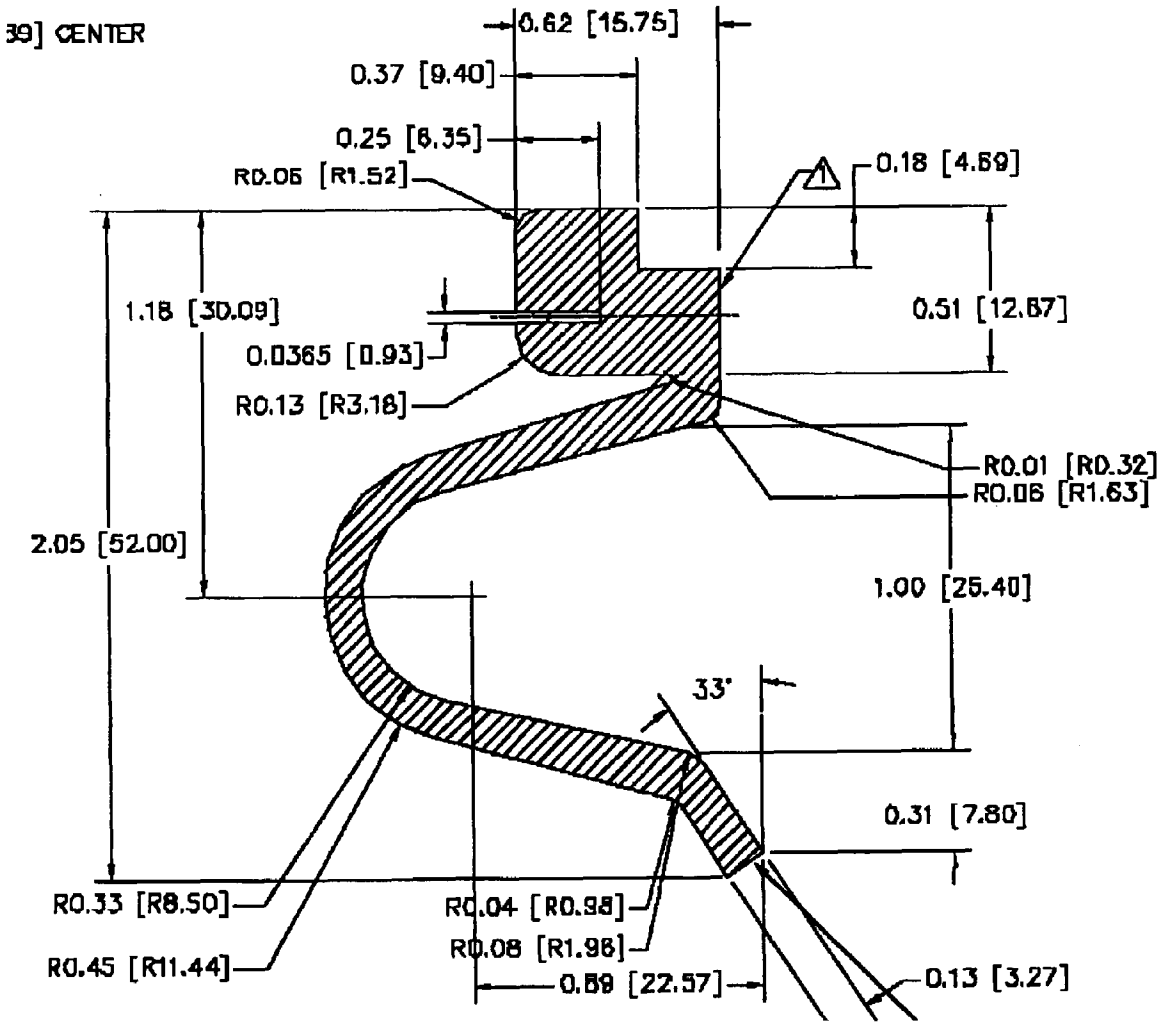
FIG. 7 shows a dimensioned drawing an embodiment of the present invention.

To achieve linearity of applied force throughout the range of cone travel, a height offset is created between the inner base and outer base edge. Height offset 170 is shown in FIG. 5. This aids linear travel, which is symmetrical in both directions of travel from the resting position. The height offset should be approx. 7.5–21% of the outer edge thickness. In an exemplary embodiment, with a base thickness of 0.15 inches a height displacement of 0.02 inches is used.

The outer base thickness can be approximately 15–45% larger than the apex thickness. The outer base thickness can be approximately 1–5% smaller than the inner base thickness.

Figure 2:
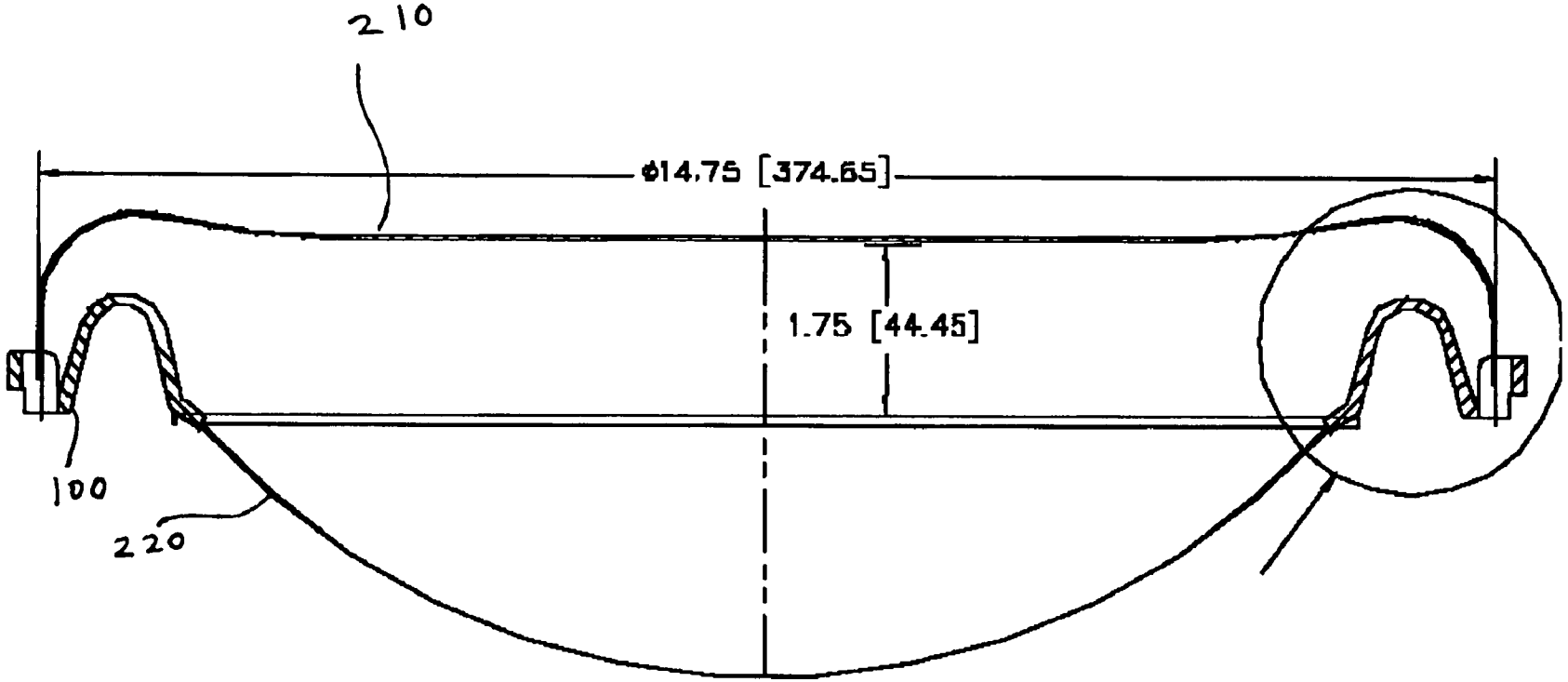
FIG. 2 shows a surround with a grill installed into the integrated gasket.
Figure 3:
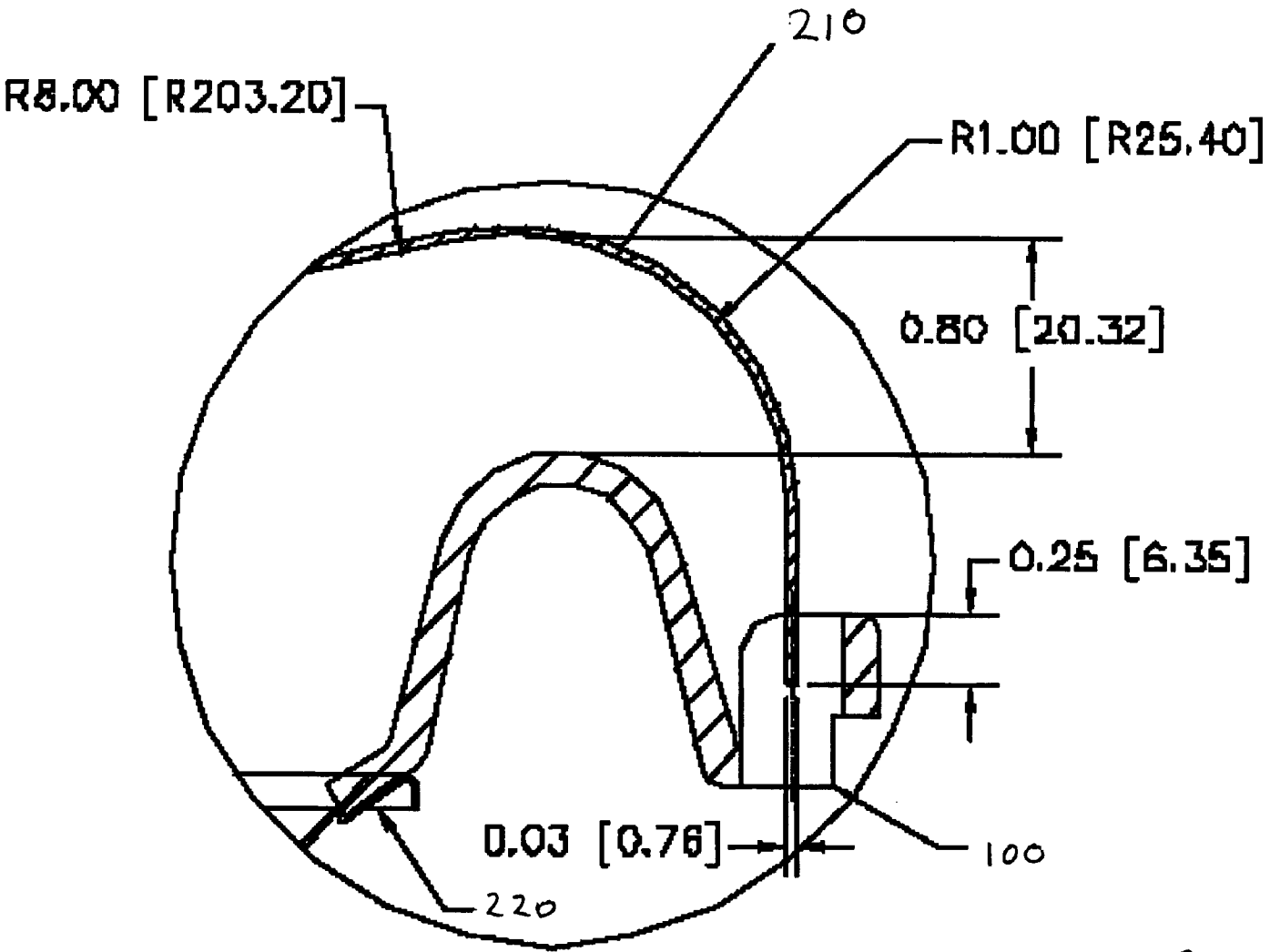
FIG. 3 shows a detailed view of a grill installed into the integrated gasket.

FIG. 2 shows a cross section of a grill 210 inserted in the groove 160 of surround 100 and spanning the opening in front of the cone 220. FIG. 3 shows a detail of the surround and the gasket inserted in the groove.

Figure 4:
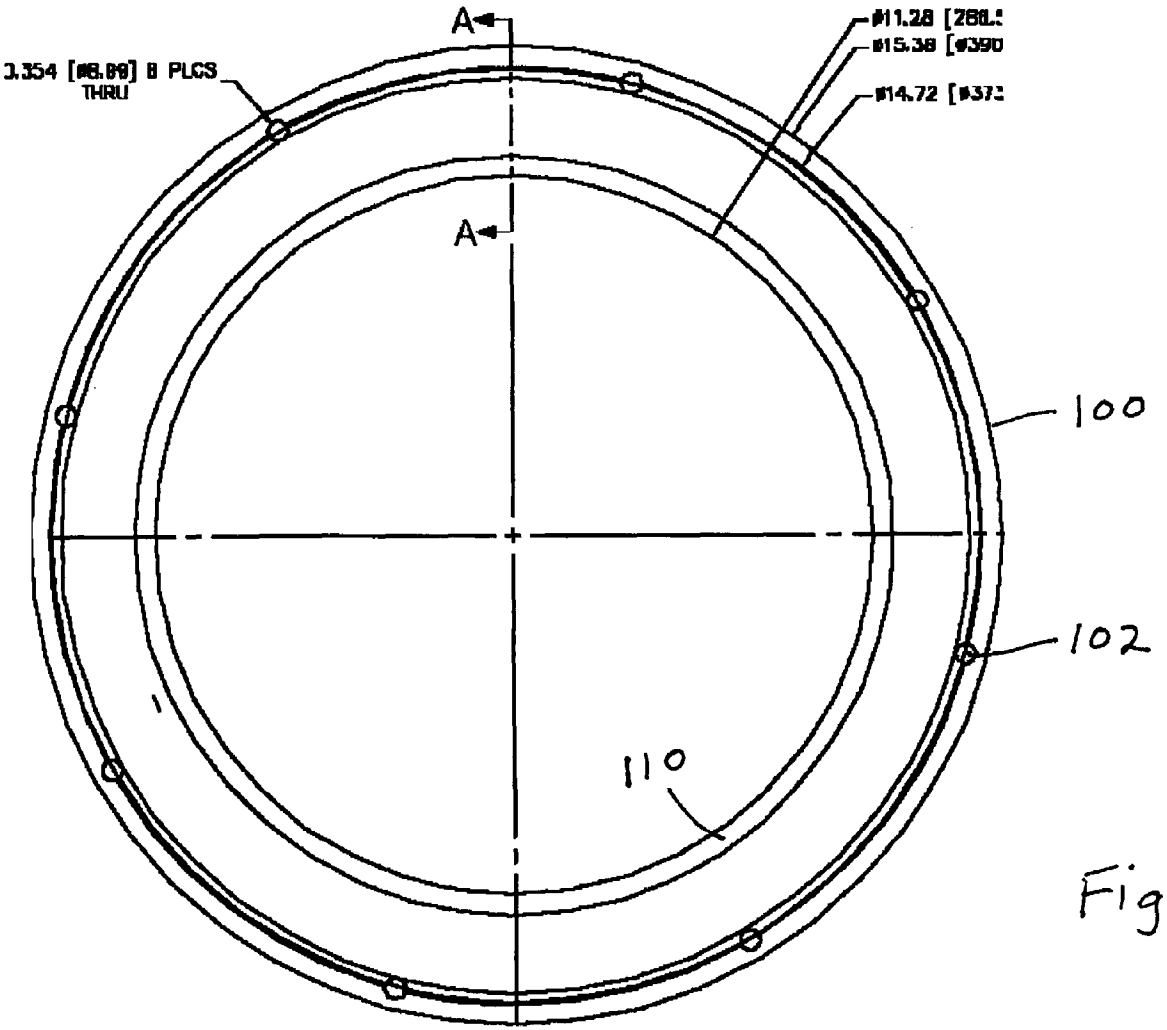
FIG. 4 shows a front view of a surround according to the present invention.

FIG. 4 shows a view of the surround 100 as seen from the front of the driver. The inner diameter is adapted to the driver cone. The outer diameter is adapted to the driver basket. The grill determines the location of the groove. Holes 102 allow screws to pass through the surround 100 for mounting to a speaker basket.

FIG. 5 shows dimensions of a representative surround. Inner rising region has a thickness at the base of 0.15 inches, tapering to 0.12 inches at the apex. Arch region maintains the thickness at 0.12 inches to the transition to the outer rising region that tapers to 0.17 inches at the base. Inner rising region has an angle of 12 degrees from vertical and outer rising region has an angle 14 degree from vertical. Arch region has an inner radius of curvature of 0.33 inches. Arch region traverses an angle of approximately 154 degrees and is approximately 0.8 inches wide at the rising regions apex.

Other thicknesses can be used for the tapered surround. For example, the surround can have a thickness of 0.06 inches, tapering to 0.04 inches. Alternatively, thicker or thinner dimensions can be used. The tapering ratio can be for the inner region can be different from the outer region.

Alternatives to the construction of a surround according to the present invention can use a symmetric profile, as in the previous example, or a non-symmetric profile of thickness and height.

The preferred technique for fabricating the surround is injection molding using EPDM (ethylene propylene diene monomer) or SANTOPRENE or SARLINK elastomer. Desirable properties of the elastomer are:

Tensile Strength: 3,000

Elongation, max. 6×

Hardness, Shore A 30–90

Other elastomers suitable for use are butadiene rubber, butyl rubber, chlorinated polyethylene, chloroprene/neoprene, chlorinated sulfonate polyethylene, epichlorohydrin, fluorocarbon, fluorosilicone, natural rubber, neoprene, nitrile butadiene, polyacrylate, polyisoprene, silicone, styrene butadiene, and urethane.

Other fabrication techniques and material commonly used for constructing flexible items can be employed. Another example of a surround construction technique is foam compression molding, where polyester or polyether foam is compressed by a mold to form the surround. Another example of a construction technique is molding using expanding foam rubber such as closed cell urethane foam.

It is desirable to keep the surround as narrow as possible to allow for maximum cone area while achieving maximum travel for cone movement. Increased cone area increases air volume displacement for a given amount of excursion. The shape of the surround was designed using finite element analysis and testing to maximize linearity and increase the excursion while remaining only one inch wide.

What is claimed is:

1. A speaker driver surround of a substantially circular shape with a plurality of distinct concentric regions comprising at the inner most edge of the surround, a cone mounting region for attaching the surround to a cone;

a inner rising region and an outer rising region each with a base and an apex and each rising region having the thickness at the base thicker than at the apex, the inner rising region connected to the cone mounting region;

an arch region connecting between the apex of the inner rising region and the outer rising region;

a gasket region connecting to the base of the outer rising region wherein the base of the inner rising region and outer rising region has a thickness of approximately 0.15 inches and apex of the inner rising region and outer rising region has a thickness of approximately 0.12 inches.

2. A speaker driver surround of a substantially circular shape with a plurality of distinct concentric regions comprising at the inner most edge of the surround, a cone mounting region for attaching the surround to a cone;

a inner rising region and an outer rising region each with a base and an apex and each rising region having the thickness at the base thicker than at the apex, the inner rising region connected to the cone mounting region;

an arch region connecting between the apex of the inner rising region and the outer rising region;

a gasket region connecting to the base of the outer rising region wherein a height offset between the inner rising base and the outer rising base is in the range of approximately 7.5% to 21% of the base thickness.

3. A flexible speaker driver surround for supporting a cone in a basket, having a cone attachment area and a basket attachment area, and a transition area between the cone attachment area and the basket attachment area where the thickness of the surround varies, wherein the transition area comprises an inner rising region, an arch region, and an outer rising region, wherein the surround thickness tapers in the inner rising region and the outer rising region and the surround thickness tapers in the range of 15–45%.

4. The flexible speaker driver surround of claim 3 wherein the basket attachment area comprises an integral gasket.

5. The flexible speaker driver surround of claim 3 wherein the basket attachment area comprises a groove for accepting a speaker grill.

6. The flexible speaker driver surround of claim 3 wherein the basket attachment area comprises a groove for accepting a speaker grill and an integral gasket.

7. The speaker driver surround of claim 1 wherein the gasket region has a groove with substantially parallel sides forming an opening to accept a speaker grill.

8. The speaker driver surround of claim 2 wherein the gasket region has a groove with substantially parallel sides forming an opening to accept a speaker grill.

* * * * *